US006429818B1

(12) United States Patent
Johnson et al.

(10) Patent No.: US 6,429,818 B1
(45) Date of Patent: Aug. 6, 2002

(54) SINGLE OR DUAL BAND PARASITIC ANTENNA ASSEMBLY

(75) Inventors: Greg Johnson, Aptos, CA (US); Don Keilen, Sparks, NV (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/828,532

(22) Filed: Apr. 6, 2001

Related U.S. Application Data

(63) Continuation-in-part of application No. 09/374,782, filed on Aug. 16, 1999, now Pat. No. 6,215,447, which is a continuation-in-part of application No. 09/008,618, filed on Jan. 16, 1998, now Pat. No. 5,945,954.

(60) Provisional application No. 60/163,515, filed on Nov. 4, 1999.

(51) Int. Cl.[7] ..... H01Q 1/38

(52) U.S. Cl. ..... 343/702; 343/700 MS

(58) Field of Search ..... 343/700 MS, 702, 343/767, 770, 818, 846

(56) References Cited

U.S. PATENT DOCUMENTS

| | | | | |
|---|---|---|---|---|
| 5,365,246 A | | 11/1994 | Rasinger | 343/702 |
| 5,598,169 A | * | 1/1997 | Drabeck et al. | 343/701 |
| 5,627,550 A | * | 5/1997 | Sanad | 343/700 MS |
| 5,644,319 A | * | 7/1997 | Chen et al. | 343/702 |
| 5,764,190 A | * | 6/1998 | Murch et al. | 343/702 |
| 5,880,697 A | | 3/1999 | McCarrick | 343/742 |
| 5,943,020 A | | 8/1999 | Liebendoerfer | 343/702 |
| 6,114,996 A | * | 9/2000 | Nghiem | 343/700 MS |

* cited by examiner

*Primary Examiner*—Don Wong
*Assistant Examiner*—James Clinger
(74) *Attorney, Agent, or Firm*—Fulbright & Jaworski L.L.P.

(57) ABSTRACT

A compact single or multiple band antenna assembly for wireless communications devices. One multi-band embodiment includes a high frequency portion and a low frequency portion, both fed at a common point by a single feed line. Both portions may be formed as a single stamped metal part or metallized plastic part. The overall size is suitable for integration within a wireless device such as a cell phone. The low frequency portion consists of two resonant sections which are stagger tuned to achieve a wide resonant bandwidth, thus allowing greater tolerance for manufacturing variations and temperature than a single resonant section, and is useful for single band antennas as well as multi-band antennas where it may be used to enhance bandwidth for both sections of a dual band antenna as well. The resonant sections for single or multi-band antennas operate in conjunction with a second planar conductor, which may be provided by the ground trace portion of the printed wiring board of a wireless communications device. The antenna assembly provides a moderate front-to-back ratio of 3–12 dB and forward gain of +1 to +5 dBi. The front to back ratio reduces the near field toward the user of a hand held wireless communications device, thus reducing SAR (specific absorption rate) of RF energy by the body during transmit. The antenna pattern beamwidth and bandwidth are increased for a handset during normal user operation, as compared to a half wave dipole.

30 Claims, 15 Drawing Sheets

SINGLE OR DUAL BAND PARASITIC ANTENNA ASSEMBLY

This application claims the benefit of priority pursuant to 35 U.S.C. §119 of copending PCT application Ser. No. PCT/US00/30428 filed Nov. 4, 2000.

PCT application Ser. No. PCT/US00/30428 filed Nov. 4, 2000, claimed the benefit of U.S. Provisional Application No. 60/163,515 filed Nov. 4, 1999.

This application is a continuation-in-part application pursuant to 37 C.F.R. 1.53(b) of application Ser. No. 09/374,782, filed Aug. 16, 1999, now U.S. Pat. No. 6,215,447, which was a continuation-in-part of application Ser. No. 09/008,618 filed on Jan. 16, 1998, now U.S. Pat. No. 5,945,954.

FIELD OF THE INVENTION

The present invention relates to an antenna assembly suitable for wireless transmission of analog and/or digital data, and more particularly to a parasitic element antenna assembly for single or multiple band wireless communications devices.

BACKGROUND OF THE INVENTION

There exists a need for an improved antenna assembly that provides a single and/or dual band response and which can be readily incorporated into a small wireless communications device (WCD). Size restrictions continue to be imposed on the radio components used in products such as portable telephones, personal digital assistants, pagers, etc. For wireless communications devices requiring a dual band response the problem is further complicated. Positioning the antenna assembly within the WCD remains critical to the overall appearance and performance of the device.

Known antenna assemblies for wireless communication devices include:

1. External single or multi band wire dipole:

Features of this antenna includes an external half wave antenna operating over one or more frequency range; a typical gain of +2 dBi; negligible front-to-back ratio; and minimal specific absorption rate (SAR) reduction (SAR 2.7 mw/g typ @ 0.5 watt transmit power level). Multiple band operation is possible with this antenna by including LC (inductor and capacitor) traps used to achieve multi band resonances.

2. External single or multi band asymmetric wire dipole:

Features of this antenna include an external quarter wave antenna operating over one or more frequency range; typical gain of +2 dBi; and minimal front-to-back ratio and SAR reduction. LC traps may also be used to achieve multi-band resonance.

3. Internal single or multi band asymmetric dipole:

Features of this antenna include a quarter wave resonant conductor traces, which may be located on a planar printed circuit board; typical gain of +1–2 dBi; slight front-to-back ratio and reduced SAR (2.1 mw/g.). This antenna may include one or more feedpoints for multiple band operation. A second conductor may be necessary for additional band resonance.

4. Internal or single multi band PIFA (planar inverted F antenna):

Features of this antenn include a single or multiple resonant planar conductor; typical gain of +1.5 dBi; and front-to-back ratio and SAR values being a function of frequency. A dual band PIFA antenna for 824–894/1850–1990 MHz operation may exhibit 2 dB gain and present minimal front-to-back ratio and reduced SAR of 2 mw/g in the lower frequency band.

SUMMARY OF THE INVENTION

A compact single or multiple band antenna assembly for wireless communications devices is described. One multi-band implementation includes a high frequency portion and a low frequency portion, both fed at a common point by a single feedline. Both portions may be formed as a single stamped metal part or metallized plastic part. The overall size is suitable for integration within a wireless device such as a cellphone.

Further, the low frequency portion consists of two resonant sections which are stagger tuned to achieve a wide resonant bandwidth, thus allowing greater tolerance for manufacturing variations and temperature than a single resonant section. This feature is useful for single band antennas as well as multi-band antennas. This feature may also be used to enhance bandwidth for both sections of a dual band antenna as well.

The resonant sections for single or multi-band antennas operate in conjunction with a second planar conductor, which may be provided by the ground trace portion of the printed wiring board of a wireless communications device. An antenna assembly so formed provides a moderate front-to-back ratio of 3–12 dB and forward gain of +1 to +5 dBi. The front to back ratio reduces the near field toward the user of a hand held wireless communications device, thus reducing SAR (specific absorption rate) of RF energy by the body during transmit. Antenna pattern beamwidth and bandwidth is increased for a handset during normal user operation, as compared to a half wave dipole. An antenna assembly according to the present invention may provide increase beamwidth when the WCD is near the user head in the talk position, by a factor of 1.5–2.

An object of the present invention is thus to satisfy the current trends which demand a reduction in size, weight, and cost for wireless communication devices.

Another object of the present invention is the provision of multiple stagger-tuned resonant elements to enhance operational beamwidth and bandwidth, and providing an improved margin for manufacturing tolerances and environmental effects. An improved beamwidth and bandwidth of the handset may translate into improved communication by increasing the number of illuminated cell sites during operation.

Another object of the present invention is the provision of an antenna assembly which is extremely compact in size relative to existing antenna assemblies. The antenna assembly may be incorporated internally within a wireless handset. A unique feed system without matching components is employed to couple the antenna to the RF port of the wireless handset. The antenna assembly requires three small-area RF ground lands for mounting, and is effectively a surface mount device (SMD). Beneficially, the antenna assembly may be handled and soldered like any other SMD electronic component. Because the antenna is small, the danger of damage is prevented as there are no external projections out of the WCD's housing. Additionally, portions of the antenna assembly may be disposed away from the printed wiring board and components thereof, allowing components to be disposed between the antenna assembly and the printed wiring board (PWB).

Another object of the present invention is an antenna assembly providing substantially improved electrical performance versus volume ratio, and electrical performance versus cost as compared to known antenna assemblies. Gain of the antenna assembly according to the present invention may be nominally equal to an external ¼ wave wire antenna, with SAR level less than 1.6 mw/g achieved at 0.5 watt input for an internally mounted antenna. The 3 dB beamwidths are significantly higher than a dipole antenna during normal user operation. The performance characteristics are found across a wide range of environmental operating conditions, e.g, at temperatures ranging from −40 to +60 degrees C.

Components of the antenna assembly may be manufactured in different ways. It is conceivable for example that the antenna can be formed from a punched or etched sheet. In a preferred embodiment, the antenna may be formed from a single-piece metal stamping adaptable to high volume production. Additionally, capacitor elements may be coupled to the antenna assembly through known high volume production techniques.

Another object of the present invention is to provide an antenna assembly having improved operational characteristics, including an increased front-to-back ratio and a decreased specific absorption rate of RF energy to the user of an associated wireless communications device.

Accordingly, it is the primary object of the present invention to provide an improved antenna assembly for communications devices including portable cellular telephones and PCS devices with improved directionality, broadband input impedance and increased signal strength. The present invention additionally reduces radio frequency radiation incident to the user's body and reduces the physical size requirements for a directional antenna assembly used on communications devices.

It is still an additional object of the present invention to provide a compact antenna assembly suitable for incorporation within the housing of a portable wireless communication device. The current invention provides compact, discrete antenna assembly without external appendages, such as provided by known external dipole antennas.

BRIEF DESCRIPTION OF THE DRAWINGS

The accompanying drawings illustrate preferred embodiments of the invention and together with the description, serve to explain the principles of the invention. In the drawings.

DETAILED DESCRIPTION OF PREFERRED EMBODIMENTS

Figure 1:
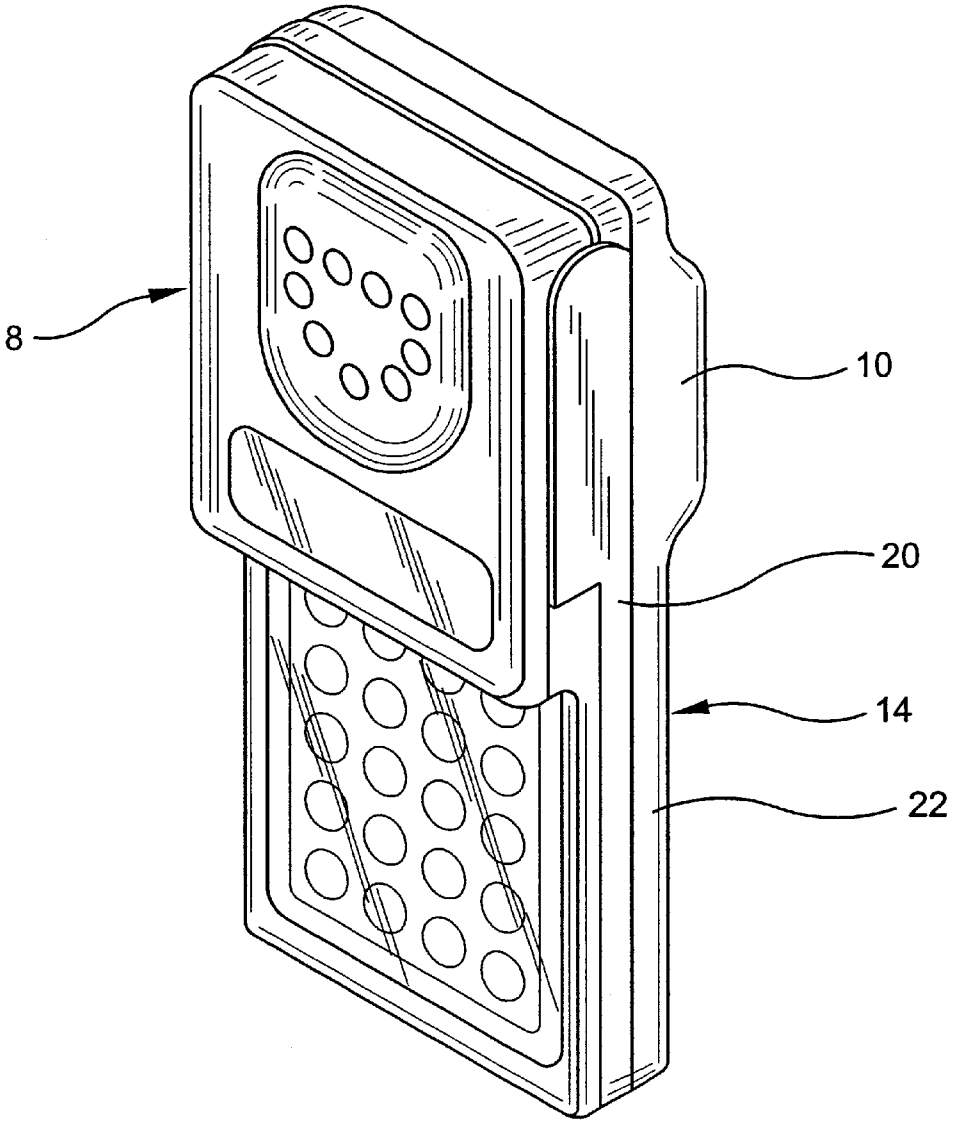
FIG. 1 is a perspective view of a communication device incorporating an antenna assembly according to the present invention.
Figure 2:
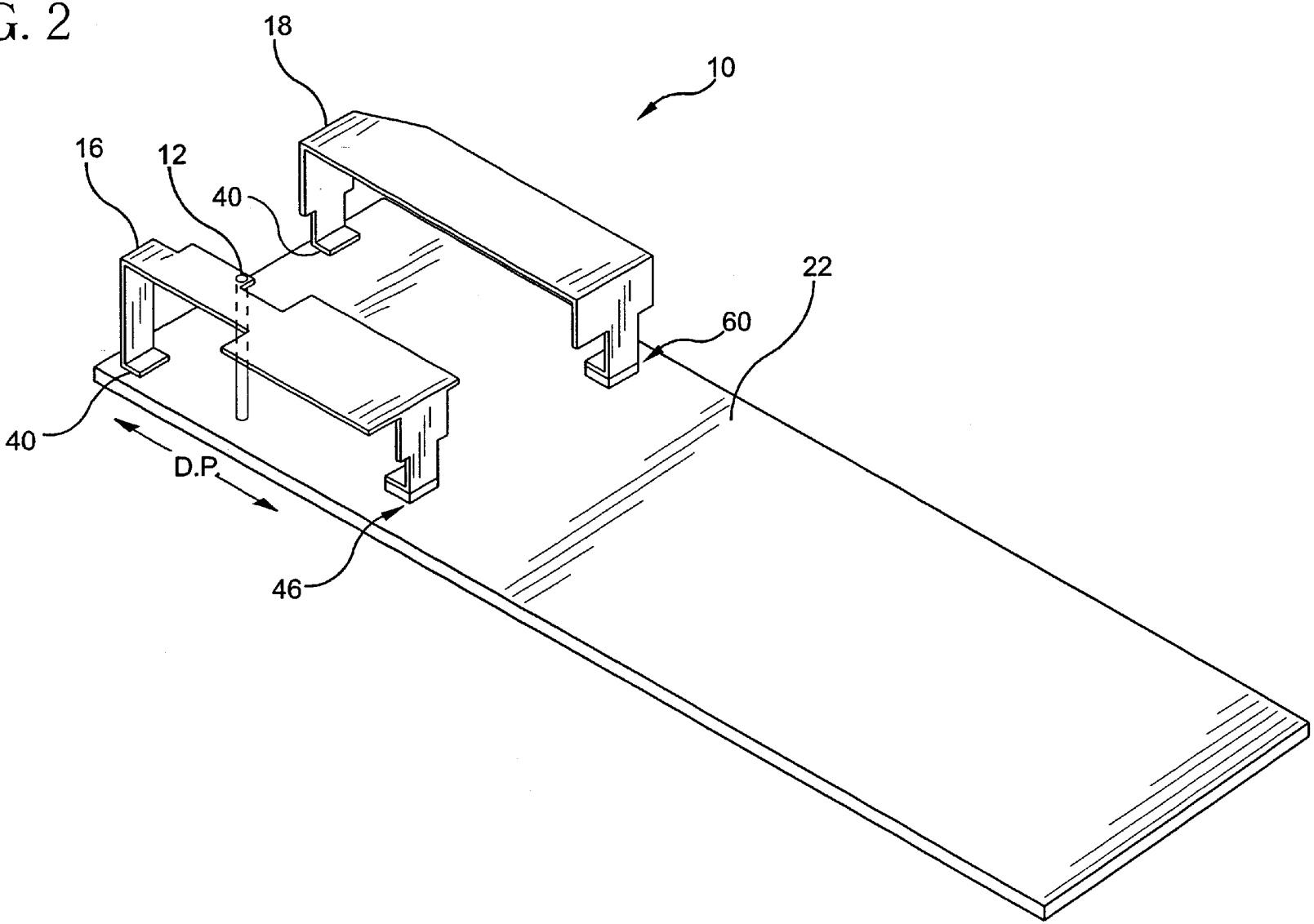
FIG. 2 is a perspective view of an antenna assembly according to the present invention.
Figure 3:
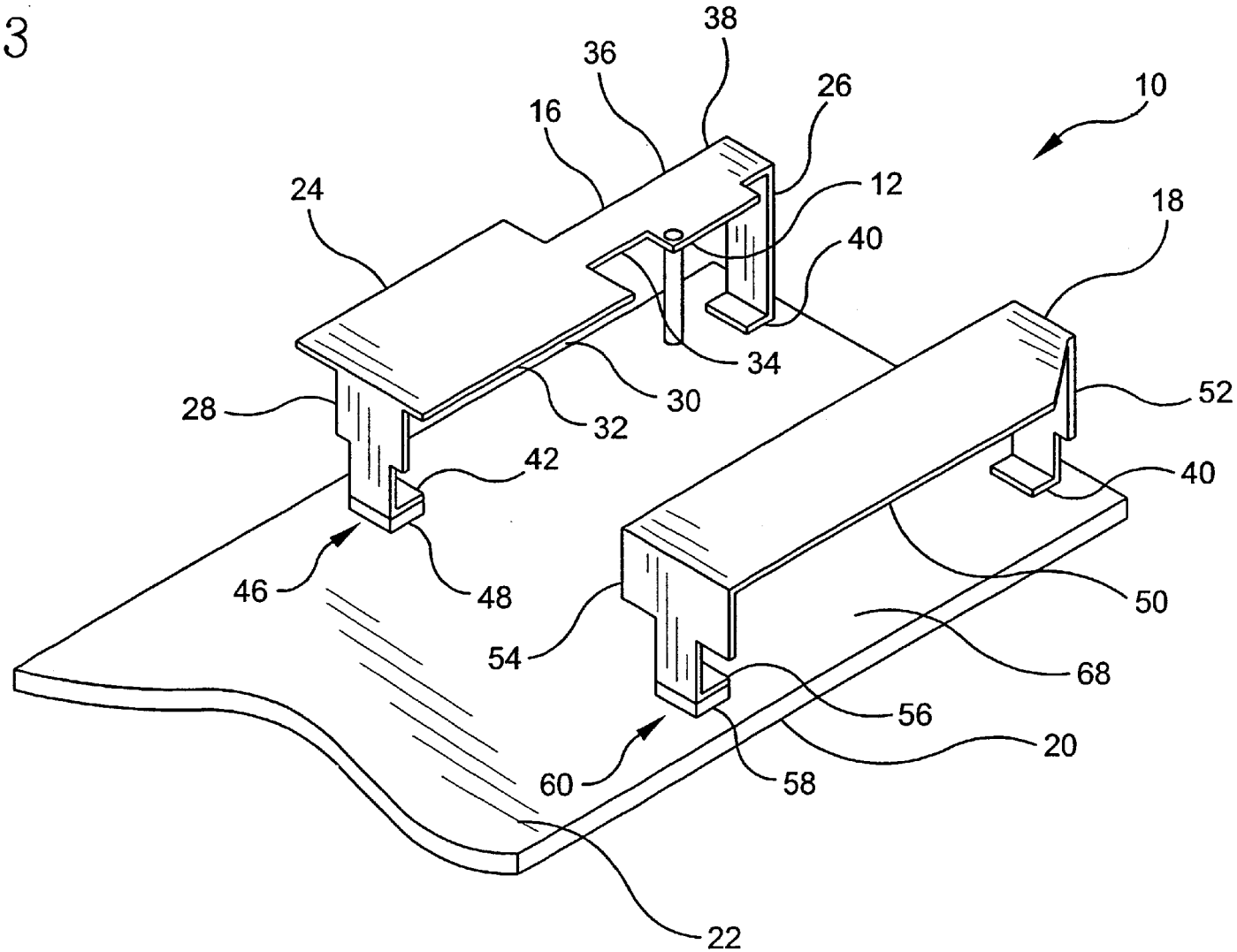
FIG. 3 is a perspective view of an antenna assembly according to the present invention.

Referring now to the drawings, wherein like numerals depict like parts throughout, FIG. 1 illustrates a wireless communication device 8, such as a cellular telephone, utilizing an antenna assembly 10 according to the present invention and operating over the cell band frequency range of 824–894 MHz. The antenna assembly 10 may be disposed within the communication device 8 at the rear panel 14 and proximate the upper portion of the handset (away from a user's hand), as illustrated in the embodiment of FIG. 1. A first embodiment of an antenna assembly 10 includes a driven conductor element 16 and a parasitic conductor element 18 each disposed relative to a ground plane element 20 of the wireless communication device 8 is illustrated in FIGS. 2 and 3. The ground plane element 20 may be defined as a portion of the printed wiring board (PWB) 22 of the communication device 8. Driven conductor element 16 includes a conductive surface 24 with first and second leg elements 26, 28 and may be a singularly formed metallic member. Driven conductor element 16 may be a metallic chassis made, for example, of copper or a copper alloy. The driven conductor element 16 is approximately "C" shaped when viewed from its side and defines an interior region 30 disposed between the conductive surface 24 and the ground plane element 20. Components of the communication device 8 may thus be disposed within the interior region 30 to effect a reduction in overall volume of the device.

The conductive surface 24 is disposed a predetermined distance above the ground plane element 20 and includes a plurality of sections having different widths for effecting optimal operation over the cell band frequency range (824–894 MHz.). A first rectangular section 32 is approximately 0.42 inch by 0.61 inch in size for a preferred embodiment. A second rectangular section 34 disposed at an upper edge of the first section 32 is approximately 0.1 inch by 0.42 inch in size. A third rectangular section 36 disposed at an upper edge of the second section 34 is approximately 0.2 inch by 0.25 inch in size. A fourth rectangular section 38 disposed at an upper edge of the third section 36 is approximately 0.15 inch by 0.13 inch in size. Other dimensions for a preferred embodiment of the present invention are disclosed in FIGS. 8–9 and Table 1.

Conductive surface 24 is electrically or operatively connected at an upper edge of the fourth section 38 to a downwardly-directed, perpendicular first leg element 26 which is shorted to the ground plane 20 at foot 40. One or more feet 40 may be practicable to provide for stability of the driven element 16 or routing requirements of the printed wiring board 22 of the communication device. Preferably a single foot 40 is utilized to minimize the contact requirements to the ground plane 20 and otherwise minimize physical interference with other components of the printed wiring board 22.

Figure 16:
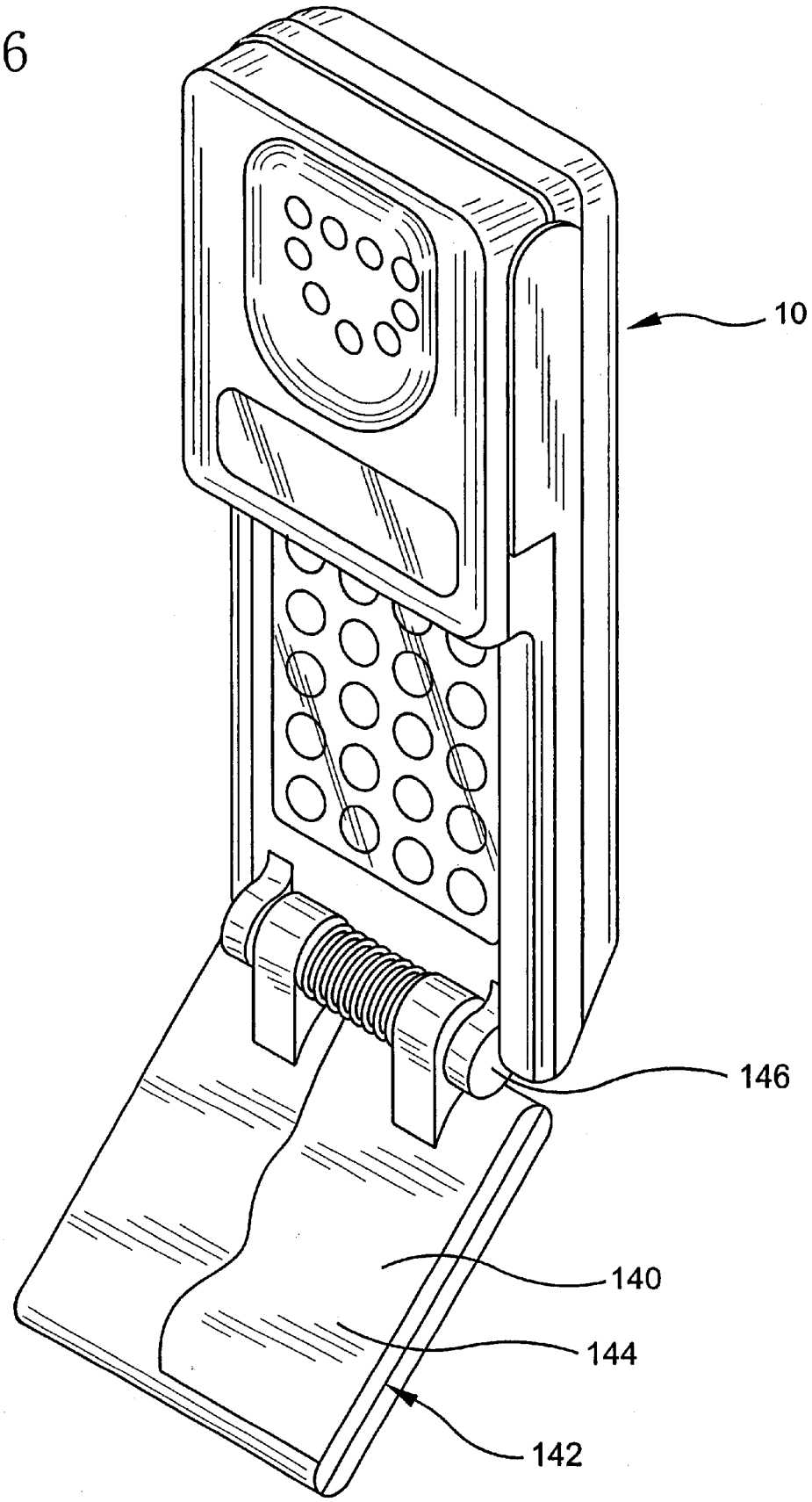
FIG. 16 is a perspective view of a hand-held communications device according to another aspect of the present invention wherein the ground plane element of the antenna assembly is extended into a flip-portion of the communications device.

Conductive surface 24 is also coupled at a lower edge of the first section 32 to a downwardly-directed perpendicular second leg element surface 28. Second leg element 28 includes a 'T' shaped profile to minimize the interference with other components of the printed wiring board 22. Second leg element 28 includes a perpendicular foot 42 for capacitively coupling driven conductor 16 to the ground plane member 20. One or more feet 42 may be practicable to provide for conductor stability or wire routing requirements of the printed circuit board 22 the communication device. Ground plane element 20 preferably has a minimum length in a direction of polarization 'DP' of approximately one-quarter wavelength (for a wavelength within the range of operation). Reference may be made to FIG. 16, wherein an approach to extending the ground plane member 20 of a small hand-held communication device is provided. Driven conductor element 16 may be a single metallic formed element having a thickness within the range of 0.005 to 0.09 inch.

Second leg element 28 includes a foot 42 which defines one side or plate of a two plate capacitor 46. Foot 42 is spaced away from the ground plane element 20 by a dielectric element 48 so as to form a capacitor. Dielectric element 48 may have a dielectric constant of between 1–10, and preferably approximately 3.0.

The parasitic element 18 of antenna assembly includes a 'C'-shaped element which is spaced away from the driven element 16. Parasitic element 18 includes a conductive portion 50 with first and second leg portions 52, 54. The conductive leg portions 50, 52, 54 of the parasitic element are substantially parallel with and correspond to conductive surfaces and the first and second leg elements 24, 26, 28 of the driven element 16. Parasitic element 18 is supported above ground plane 20 by the second leg portion 54 which is capacitively coupled to the ground plane 20 via foot 56 and dielectric member 58. As with the foot 42 and the dielectric element 48 of the driven element 16 forming a two plate capacitor 46, the foot 56 and the dielectric element 58 of the parasitic element 18 form a two plate capacitor 60. The parasitic element 18 is further supported by a first leg portion 52 which is electrically or operatively connected to the ground plane element 20 via foot 40. Note that the parasitic element 18 includes an interior region 68 similar to the interior region 30 of the driven element.

Figure 4:
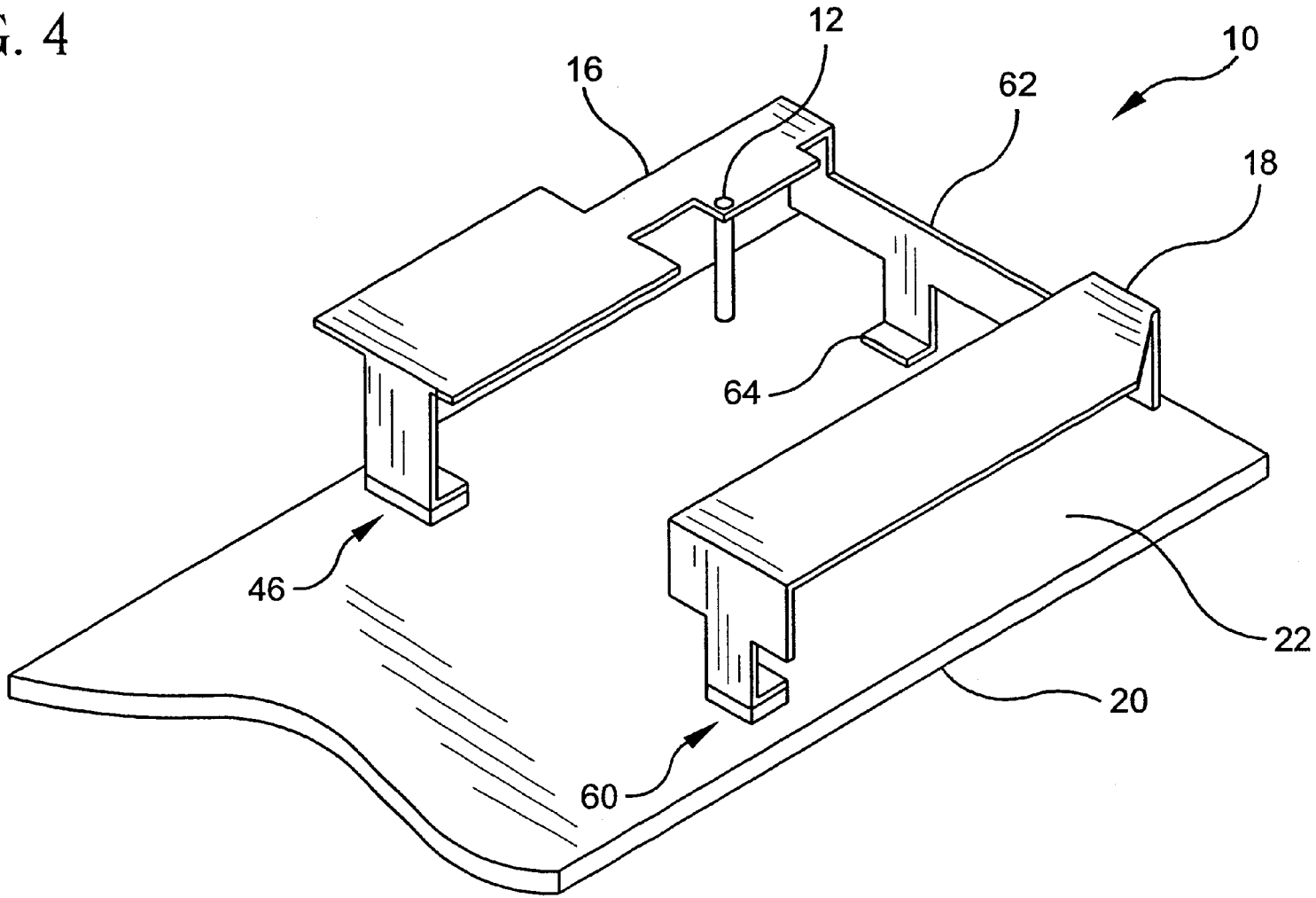
FIG. 4 is a perspective view of another embodiment of an antenna assembly according to the present invention.

FIG. 4 illustrates another embodiment of an antenna assembly 10 according to the present invention. The driven element 16 and the parasitic element 18 are coupled together via a coupling element 62. The coupling element 62 includes a foot 64 for operatively coupling both the driven element 16 and the parasitic element 18 to the ground plane 20 of the communication device. The driven element 16, parasitic element 18, and coupling element 62 may be formed from as a single metal part and be fabricated, for example, using high-speed metal stamping processes. In this manner, a compact antenna assembly is provided which is suitable for incorporation within efficient, high volume production of communication devices. The antenna element may thus be utilized in conjunction with surface mount device (SMD) production techniques.

Figure 5:
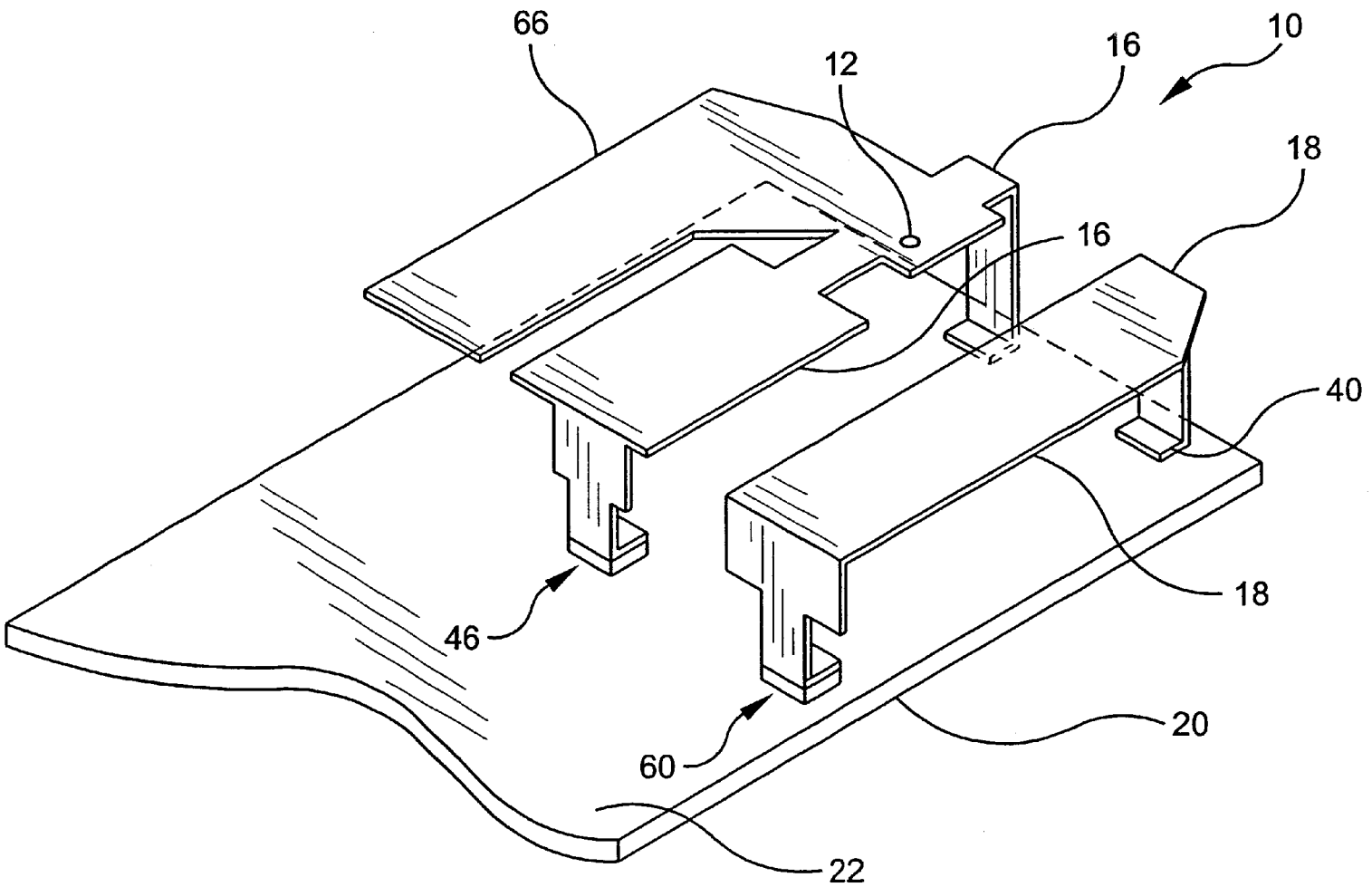
FIG. 5 is a perspective view of yet another embodiment of an antenna assembly according to the present invention including a dual band antenna circuit with parasitically coupled stagger tuned sections for the lower frequency band, and a single resonant section for the higher frequency band.

FIG. 5 illustrates another embodiment of an antenna assembly according to the present invention. The antenna of FIG. 5 optimally operates over a pair of frequency ranges, for example, such as cell band (824–894 MHz.) and PCS band (1850–1990 MHz.) ranges. Operation over a higher frequency range is attained by addition of an extension element 66 to the driven conductor element 16. Preferably, extension element 66 is disposed at a left side edge of the third portion 36 of the driven element 16. Dimensions of the extension element 66, which are sized to effectuate resonance at the higher frequency range, are provided in FIG. 8 and Table 1.

Figure 6:
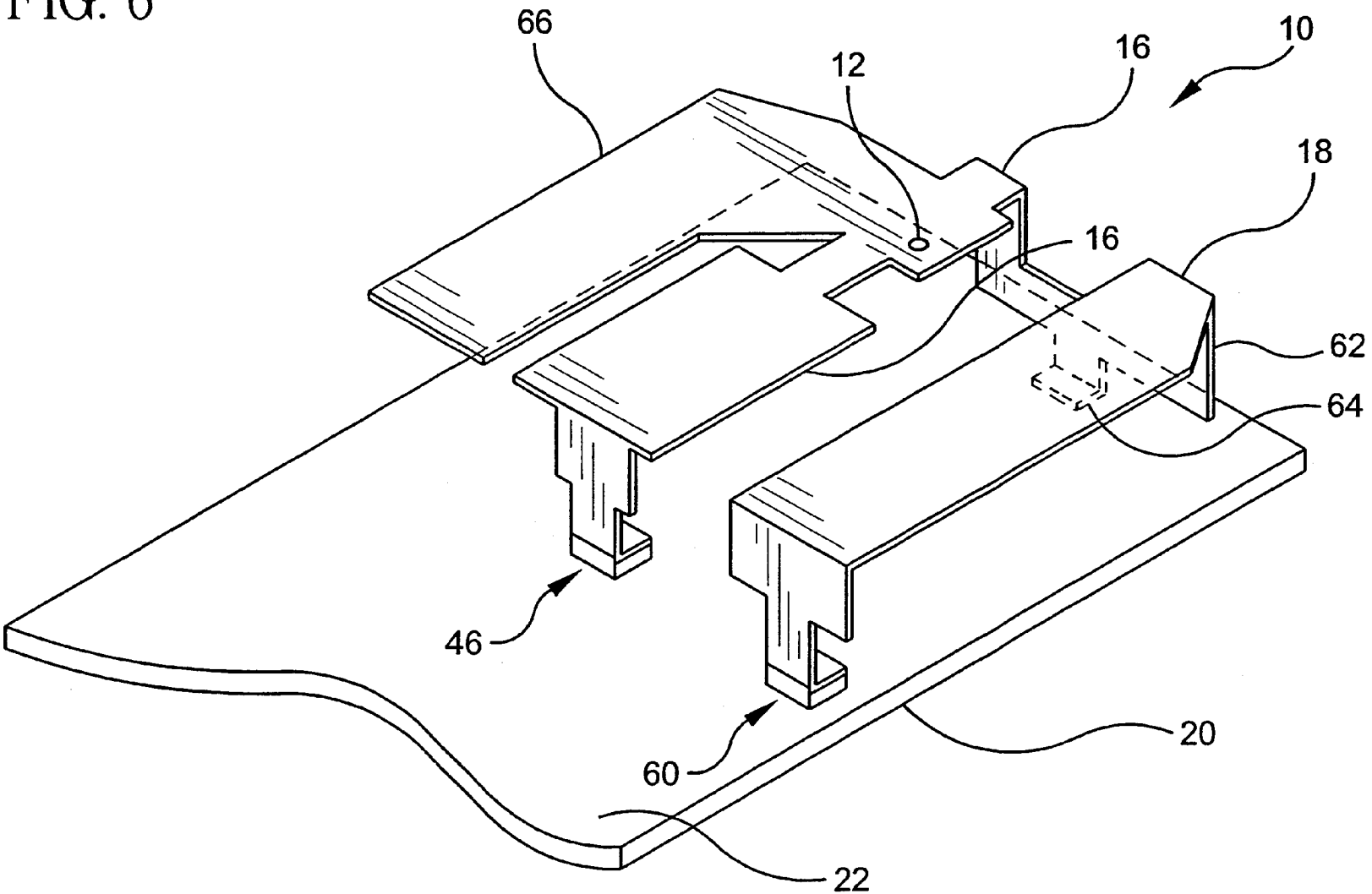
FIG. 6 is a perspective view of yet another embodiment of an antenna assembly according to the present invention providing sections joined to facilitate construction as a single stamped part.

FIG. 6 illustrates another embodiment of an antenna assembly according to the present invention. Similarly to FIG. 4, the driven element 16, parasitic element 18, and coupling element 62 are formed as a single unit and operatively connected to the ground plane member 20 at a single ground location via foot 64.

Figure 7:
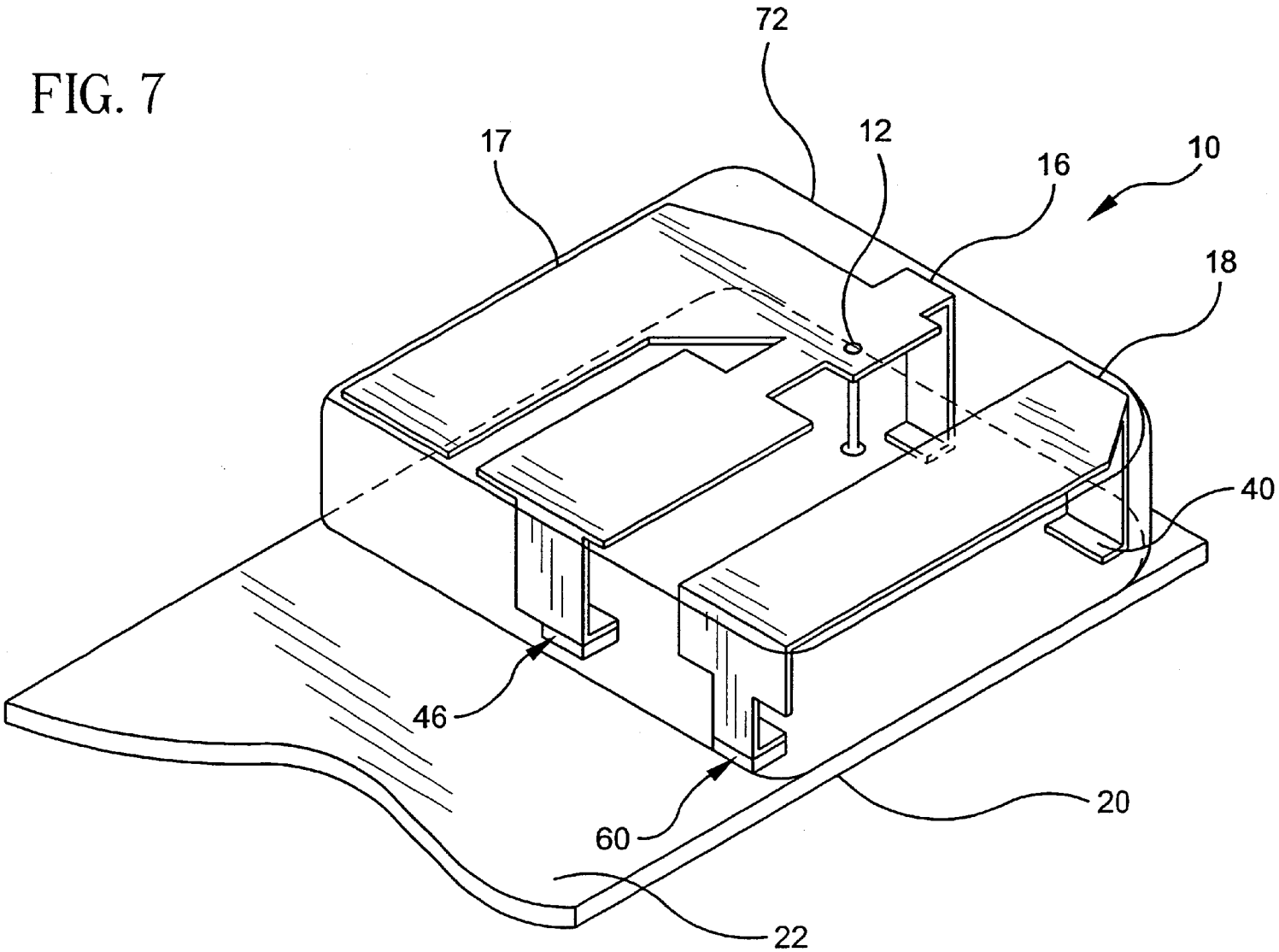
FIG. 7 is a perspective view of yet another embodiment of an antenna assembly according to the present invention.

FIG. 7 illustrates yet another embodiment of an antenna assembly according to the present invention. The driven element 16, parasitic element 18, and coupling element 62 are disposed upon a dielectric block or substrate 72. The driven element 16, parasitic element 18, and coupling element 62 may be a metal deposition upon the dielectric substrate 72 or formed using other known metal deposition or metal etching processes as those skilled in the relevant arts may appreciate.

Figure 9:
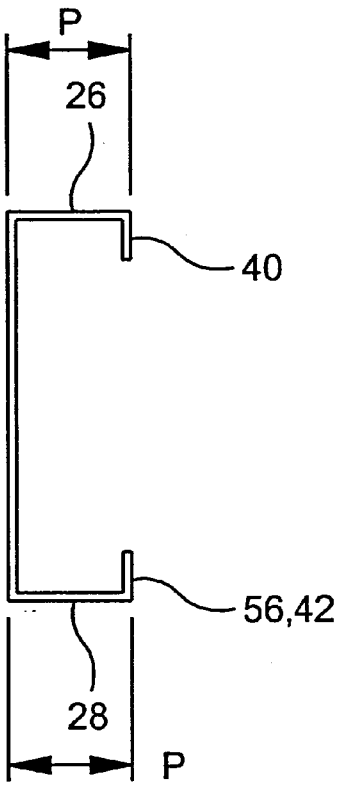
FIG. 9 is a side elevational view of the antenna assembly of FIG. 8.
Figure 8:
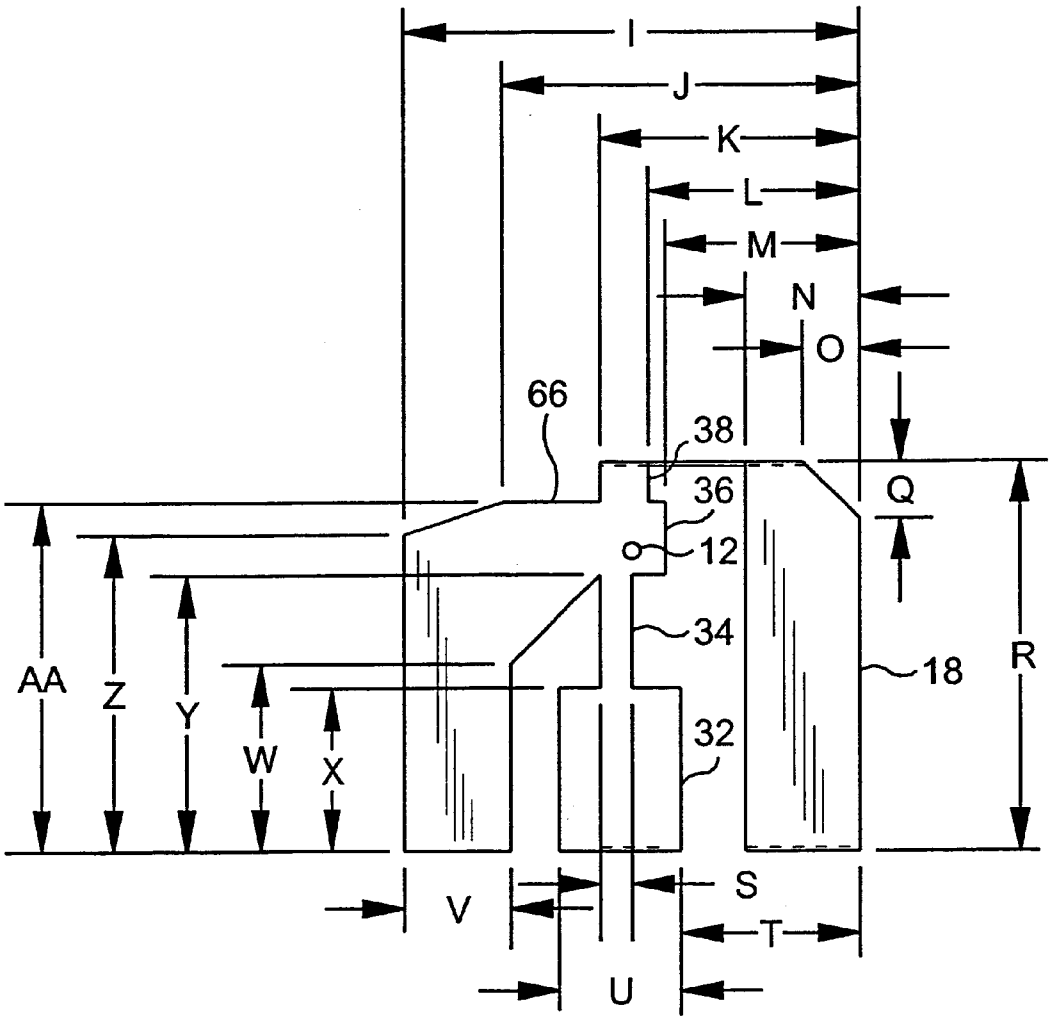
FIG. 8 is a top plan view of an antenna assembly according to the present invention as represented in FIGS. 1–7.

FIGS. 8 and 9, in conjunction with Table 1, disclose dimensions for preferred embodiments of an antenna assembly according to the present invention.

Figure 10:
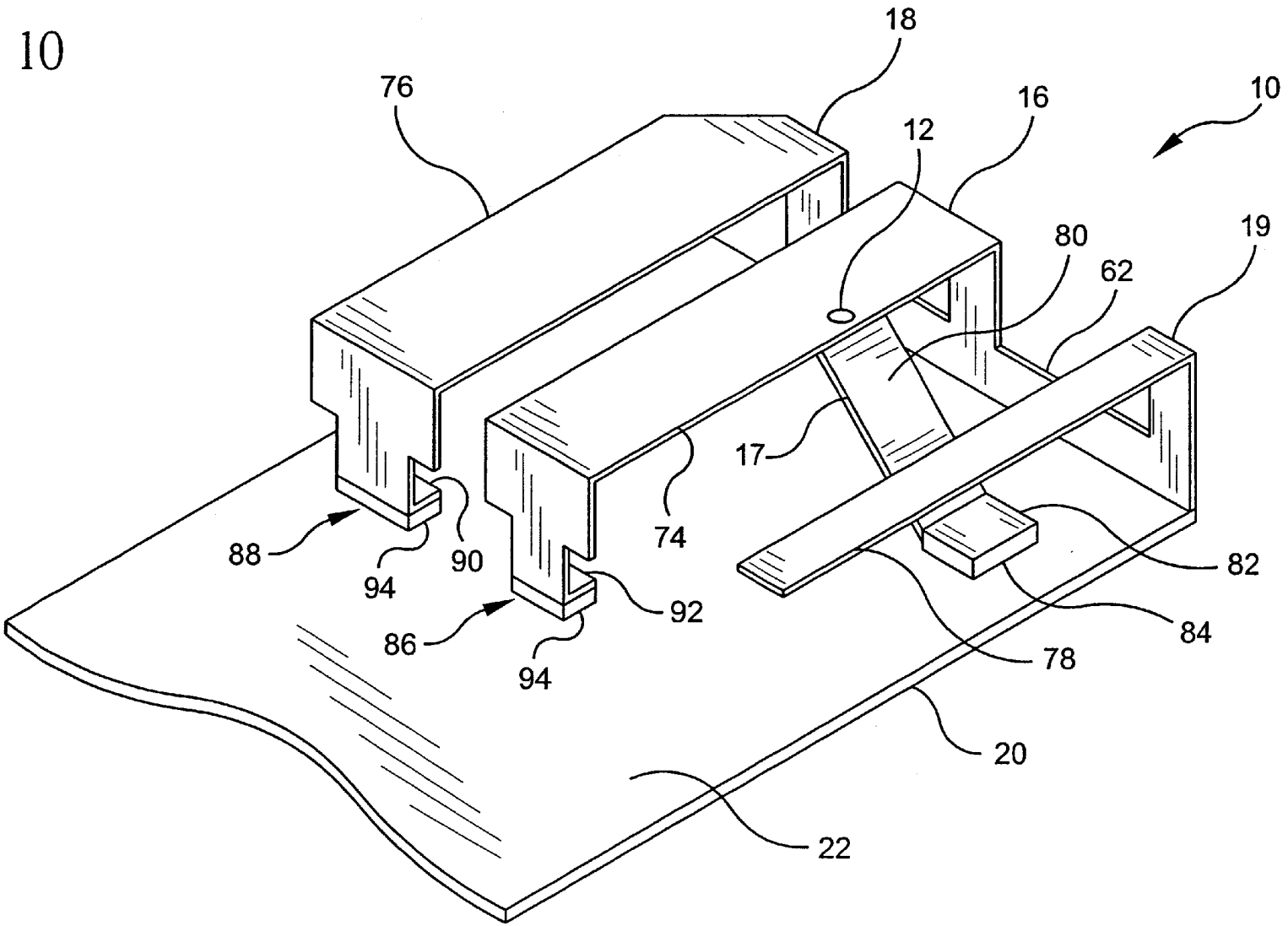
FIG. 10 is a perspective view of yet another embodiment of an antenna assembly according to the present invention.

FIG. 10 illustrates another embodiment of an antenna assembly according to the present invention, in particular a dual band antenna assembly suitable for operation over the cell band (824–894 MHz.) and PCS band (1850–1990 MHz.) frequency ranges. This antenna assembly includes low frequency and high frequency driven elements 16, 17 and low frequency and high frequency parasitic elements 18, 19, and for example, all elements being formed as a single stamped metal part. A coupling element 62 operatively connects the driven elements 16, 17 to the parasitic elements 18, 19 and is formed as a portion of the stamped metal part. Coupling element 62 is, in turn, operatively connected to the ground plane member 20 of the communication device 8 at an upper edge thereof. Low frequency driven element 16, low frequency parasitic element 18, and high frequency parasitic element 19 are each defined by a substantially rectangular planar top surface 74, 76, 78. The top surfaces 74, 76, 78 are substantially co-planar. The high frequency driven element 17 is defined by a substantially rectangular element 80 disposed at a side of the low frequency driven element 16 and downwardly angled toward a foot 82. Foot 82 is disposed upon a dielectric element 84 to capacitively couple the high frequency driven element 17 to the ground plane member 20 of the communication device. Dielectric member 84 may be a 1/32 inch thickness dielectric substrate having a dielectric constant between 1 and 10, and preferably about 3.0. Dielectric member 84 may be a dielectric substrate such as used for printed circuit boards, having a dielectric constant in the range of 1–10, or dielectric member 84 may be a chip capacitor.

Low frequency driven element 16 and low frequency parasitic element 18 are each operatively coupled at one end to the ground plane member 20 of the communication device via a capacitive coupling 86, 88 defined between a foot member 90, 92 and the ground plane 20. A dielectric element 94 may be disposed within each capacitive coupling 86, 88. In comparison, high frequency parasitic element 19 includes a free end.

The antenna assembly of FIG. 10 includes a feed point 12 at which a single conductor from the communication device may be coupled thereto. Operation at alternative frequency ranges may be practicable utilizing the concepts of this embodiment by scaling the relevant dimensions provided herein as those skilled in the arts will appreciate.

Figure 11:
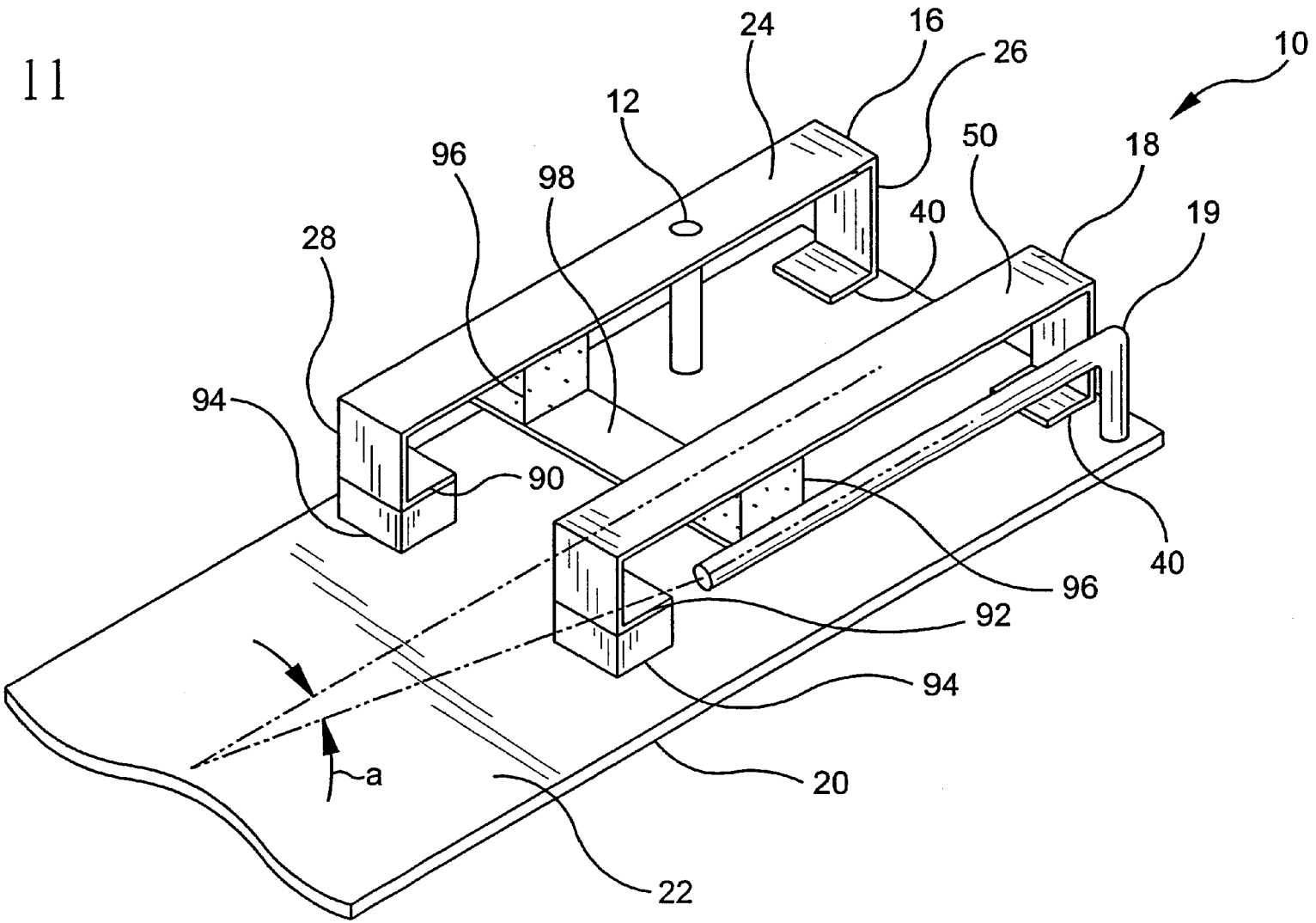
FIG. 11 is a perspective view of yet another embodiment of an antenna assembly according to the present invention.

FIG. 11 illustrates another embodiment a multiple band antenna assembly of the present invention. Driven element 16 is coupled at feed point 12 to the communication device via a single conductor. Driven element 16 is approximately 'C' shaped when view in profile and includes a top planar surface including the feed point 12, a first leg element 26 operatively connected near the upper edge of the ground plane element 20 of the printed wiring board via foot member 40, and a second leg element 28 capacitively coupled to the ground plane element 20 via foot 92 and capacitor element 94. A parasitic element 18 is disposed relative the driven element 16 and is similarly shaped. Parasitic element 18 is directly or operatively connected at one end near the upper edge of the ground plane element 20, and capacitively coupled at another end to the ground plane element 20. A perpendicular coupling section 98 is disposed between the driven element 16 and the low frequency parasitic element 18. Coupling section 98 is capacitively coupled to the driven element 16 and the low frequency parasitic element 18 via capacitor elements 96. The dielectric constant of the capacitor elements 96 may range from 1 (air) to approximately 10.

Antenna assembly of FIG. 11 further includes a high frequency parasitic element 19 directly or operatively connected at one end to the ground plane element 20 of the telecommunication device. High frequency parasitic element 19 may be a conductive wire element having a nominal 0.05 inch thickness and including an upper portion substantially aligned with the conductive surface and conductive portion 24,50, respectively, of the driven element 16 and low frequency parasitic element 18. Note that high frequency parasitic element 19 is angled relative to the low frequency parasitic element 18 by an angle "$\alpha$" of between approximately 5–25 degrees.

Figure 12:
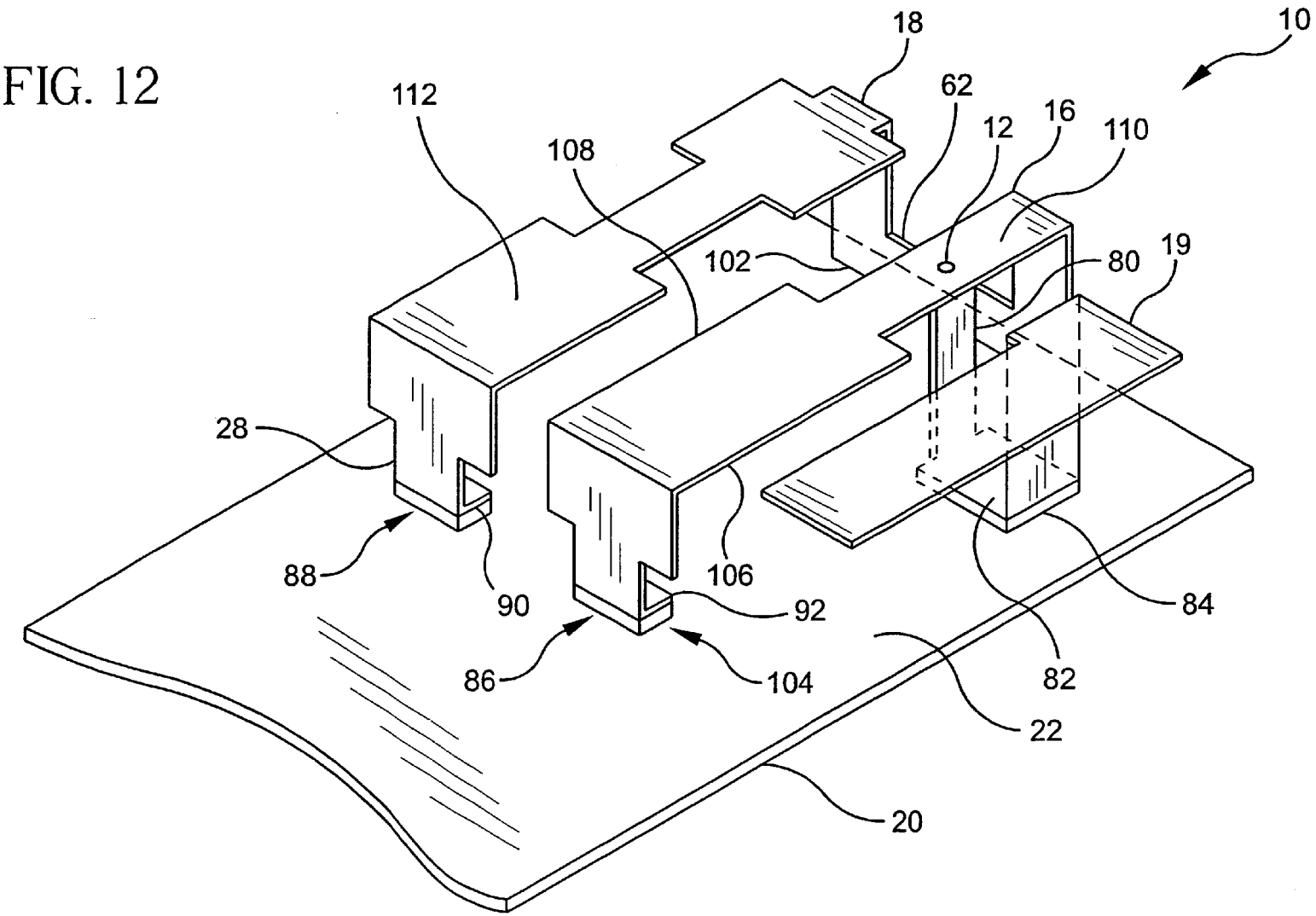
FIG. 12 is a perspective view of yet another embodiment of an antenna assembly according to the present invention.

FIG. 12 illustrates yet another embodiment of an antenna assembly 10 according to the present invention. The low frequency driven element 16 is directly or operatively connected at a first end to an upper portion 102 of the printed wiring board 22, and at a lower portion 104 of the printed wiring board 22 through capacitive coupler 86, and at feed point 12. Low frequency driven element 16 includes a top planar surface 106 including first and second portions 108, 110, the first portion 108 defined by a substantially rectangular area and the second portion 110 defined by a relatively smaller rectangular area. Feed point 12 is disposed within the second portion 110 of the top planar surface 106. High frequency driven element 80 is directly coupled at an edge of the low frequency driven element 16 (at the second portion 110) and is capacitively coupled at the other end to the ground plane 20 of the printed wiring board via foot element 82 and dielectric element 84. High frequency parasitic element 19, which is defined by a substantially rectangular area, is also capacitively coupled to the ground plane member 20 through common foot element 82 and dielectric element 84.

Still referring to FIG. 12, the low frequency parasitic element 18, which is disposed on the opposite side of the low frequency driven element 16, is capacitively coupled at a first end to the ground plane element 20 of the printed wiring board and at the opposite end to a coupling element 62 directly connected to the ground plane element 20. Low frequency parasitic element 18 includes a top planar surface 112 having a plurality of portions defined by varying width dimension. Coupling element 62 electrically connects the low frequency parasitic element 18 to the low frequency driven element 16.

Figure 13:
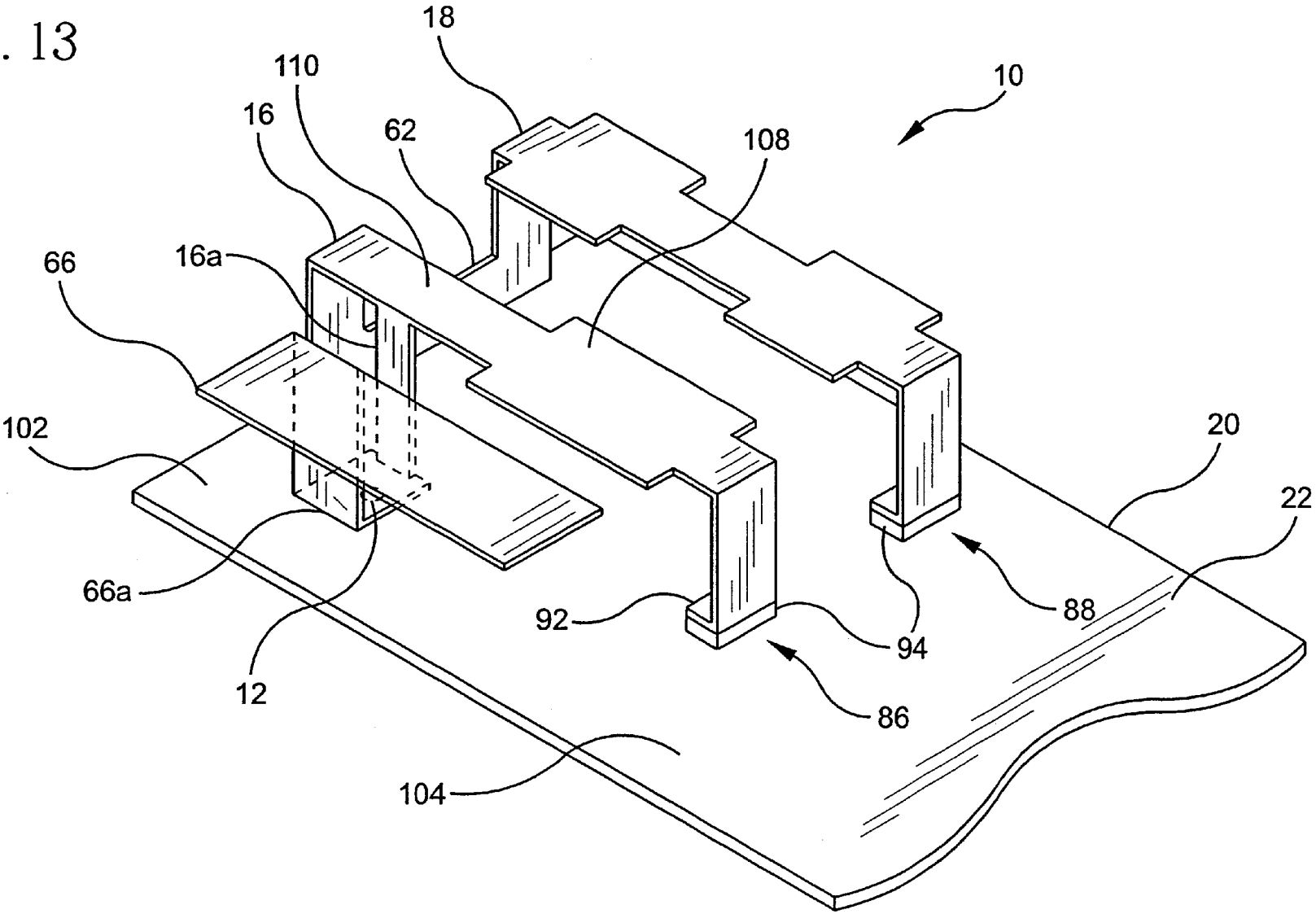
FIG. 13 is a perspective view of yet another embodiment of an antenna assembly according to the present invention.

FIG. 13 illustrates yet another embodiment of an antenna assembly 10 according to the present invention. The driven element 16 is directly or operatively connected at a first end to an upper portion 102 of the printed wiring board 22, and at a lower portion 104 of the printed wiring board 22 through capacitive coupler 86. The driven element 16 includes a top planar surface including first and second portions 108, 110, the first portion 108 defined by a substantially rectangular area and the second portion 110 defined by a relatively smaller rectangular area. Driven element 16 further includes a downwardly directed conductive surface 16*a* which is coupled at a lower foot surface to a feed point 12. Operation over a higher frequency range is attained by addition of an extension element 66 to the driven conductor element 16. Preferably, extension element 66 is disposed at a side edge away from the parasitic element 18. Extension element 66 includes a downwardly directed conductive surface 66*a* which is coupled at a lower foot surface to the feed point 12. The feed point 12 is preferably disposed a predetermined distance above the surface of the printed wiring board 22. The foot surface defining the feedpoint 12 is illustrated as a planar surface, though alternatively, the pair of downwardly directed surfaces 16*a*, 66*a* could be joined without the planar foot surface.

Still referring to FIG. 13, the parasitic element 18, which is disposed on the side of the driven element 16 opposite the extension element 66, is capacitively coupled at a first end to the ground plane element 20 of the printed wiring board 22 and at the opposite end to a coupling element 62 directly connected to the ground plane element 20. Parasitic element 18 includes a top planar surface having a plurality of portions defined by varying width dimension. Coupling element 62 electrically connects the parasitic element 18 to the low frequency driven element 16.

Figure 14:
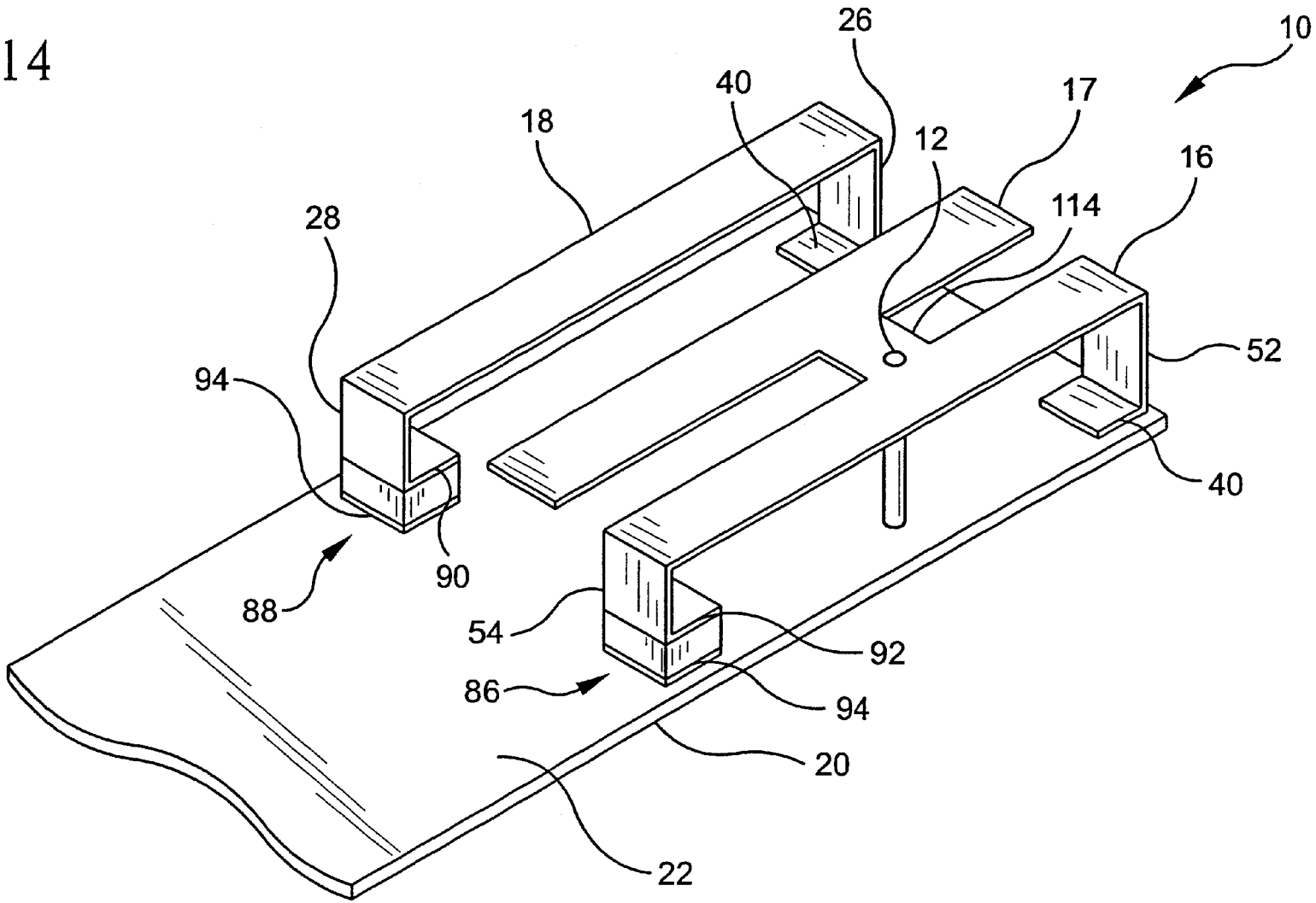
FIG. 14 is a perspective view of yet another embodiment of an antenna assembly according to the present invention.

Referring now to FIG. 14, another embodiment of an antenna assembly according to the present invention is provided. A dual band antenna includes a driven element 16 for the lower frequency band and a high frequency driven element 17 disposed away therefrom. The high frequency and low frequency driven elements 16, 17 are each defined by substantially planar rectangular portions which are coupled via a conductive spacer portion 114. A feed point 12 is provided between the driven elements 16, 17 and a signal conductor from the printed wiring board 22. A low frequency parasitic element 18 is disposed further away from the low frequency driven element 16 as indicated.

Figure 15:
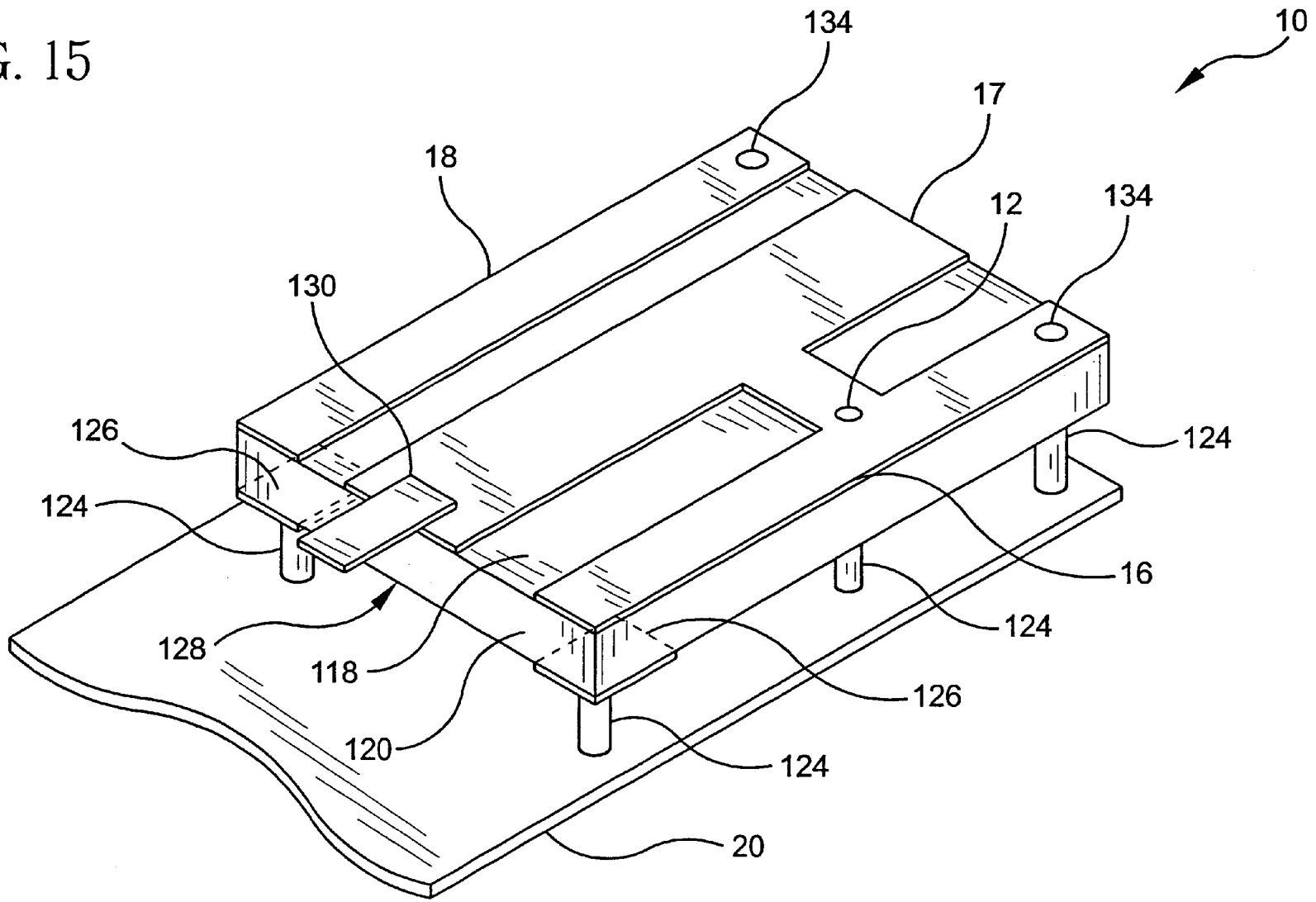
FIG. 15 is a perspective view of yet another embodiment of an antenna assembly according to the present invention.

FIG. 15 illustrates another preferred embodiment of an antenna assembly according to the present invention wherein the driven elements 16, 17 and the parasitic element 18 are disposed upon an upper major surface 118 of a dielectric block element 120. The driven elements 16, 17 and parasitic element 18 may be made as metal depositions upon the dielectric block or otherwise patterned from a plated dielectric stock material. Dielectric block element 120 has a dielectric constant of between 1 and 10, and more preferably approximately 3.0. The dielectric block 120 is supported a distance away from the printed wiring board 22 of the communication device by conductive spacer elements 124. The spacer elements 124 additionally operatively or directly connect the driven elements 16, 17 and parasitic elements 19 to the ground plane member 22 at attachment points 134. Low frequency driven element 16 and the parasitic element 18 are each capacitively coupled at respective ends to the ground plane 20. Note that bottom plate elements 126 are disposed upon the opposite major surface 128 of the dielectric substrate 120 and are electrically coupled to the ground plane member 20 via truncated conductive spacer elements 124. A tuner element 130 is disposed at one end of high frequency driven element 17 and may be adjusted relative to the ground plane element 20 to adjust the resonant frequency of the higher frequency antenna.

FIG. 16 illustrates another aspect of the present invention which provides for an extended ground plane element 140 for use in conjunction with the antenna assemblies disclosed herein. The overall length of the ground plane member 20, 140 (the electrical length) is preferably greater than one-quarter wavelength for a preselected wavelength in the operational frequency band. Applicants have determined that the electrical length of the ground plane 20, 140 in large part determines the gain of the antenna assembly. One limitation of smaller hand held communication devices is that the ground plane 20, 140 has an electrical length which is less than optimal. For communication devices having a lower flip panel portion 142, the ground plane length 20, 140 may be extended by coupling a conductive panel 144 of the flip panel portion 142 to the main ground plane 20 of the printed wiring board 22. The conductive panel 144 may be a separate conductor element or a conductive layer disposed upon an existing surface of the flip panel portion 142. The coupling device 146 may be selected from among a group of known electrical coupling techniques as appreciated by those skilled in the relevant arts.

Particular dimensions for preferred embodiments according to the present invention are included as Table 1.

TABLE 1

| Dimension | Inch |
|---|---|
| i. | 1.600 |
| j. | 1.260 |
| k. | .925 |
| l. | .775 |
| m. | .725 |
| n. | .400 |
| o. | .200 |
| p. | .395 |
| q. | .200 |
| r. | 1.330 |
| s. | .100 |
| t. | .640 |
| u. | .420 |
| v. | .360 |
| w. | .610 |
| x. | .530 |
| y. | .950 |
| z. | 1.080 |
| AA. | 1.200 |

In operation and use the antenna assemblies according to the present invention are extremely efficient and effective. The antenna assemblies provide improved directivity, broadband input impedance, increased signal strength, and increased battery life. The antenna of the present invention reduces radio frequency radiation incident to the user's body, and reduces the physical size requirements of directional antenna used in cell phone handsets, PCS devices and the like. The disclosed antenna also increases front-to-back ratios, reduces multipath interference, and is easily integrated into the rear panel portion of a cellular transceiver device to minimizes the risk of damage or interference. Additionally, beamwidth and bandwidth enhancement in the direction away from the user is achieved particularly when the antenna assembly is used in conjunction with hand-held wireless communication devices. Beamwidths of 1.5–2 times greater than for a dipole antenna have been recognized.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An antenna assembly for use in a wireless communication device, the antenna assembly comprising:

a ground plane element;

a driven element having a first conductive surface with a feed point, said first conductive surface being disposed a predetermined distance away from the ground plane element, said driven element having a first downwardly depending leg element being conductively coupled to the ground plane element and a second downwardly depending leg element being capacitively coupled to the ground plane element;

a parasitic element having a first conductive surface, said first conductive surface being disposed a predetermined distance away from the ground plane element, said parasitic element having a first downwardly depending leg element being conductively coupled to the ground plane element and a second downwardly depending leg element being capacitively coupled to the ground plane element; and a feed conductor coupled to the first conductive surface of the driven element at the feed point and to an rf signal conductor of the wireless communication device.

2. The antenna assembly of claim 1, wherein the conductive surface of the driven element includes a plurality of differently shaped sections.

3. The antenna assembly of claim 1, wherein the conductive surface of the driven element includes an extension conductor surface for resonating at a second higher frequency range.

4. The antenna assembly of claim 3, wherein the driven element and the extension conductor surface define a pair of downwardly directed conductive surfaces which are operatively coupled together, and wherein the feedpoint is defined between the pair of downwardly directed conductive surfaces.

5. The antenna assembly of claim 4, wherein the feedpoint is defined approximately midpoint between the driven element and the extension conductor surface.

6. The antenna assembly of claim 1, further comprising a second parasitic element having a conductive portion.

7. The antenna assembly of claim 6, wherein the second parasitic element includes a leg element, with the second parasitic element operatively connected to the ground plane by the leg element.

8. The antenna assembly of claim 6, wherein the second parasitic element includes a leg element, with the second parasitic element capacitively coupled to the ground plane by the leg element.

9. The antenna assembly of claim 7, wherein conductive portions of the first and second parasitic elements are skewed relative to their longitudinal axes.

10. The antenna assembly of claim 8, wherein the angle formed by the longitudinal axes of the first and second parasitic elements is approximately in the range of 5 to 25 degrees.

11. The antenna assembly of claim 1, wherein the first leg element of the driven element and the first leg element of the parasitic element each include a foot for operatively connecting the driven and parasitic elements to the ground plane.

12. The antenna assembly of claim 1, wherein the second leg element of the driven element and the second leg element of the parasitic element each include a foot and a dielectric member interposed between the foot and the ground plane for capacitively coupling the driven and parasitic elements to the ground plane.

13. The antenna assembly of claim 1, further comprising a coupling element joining the first leg element of the driven element and the first leg element of the parasitic element together, the coupling element having a foot for operatively connecting the driven and parasitic elements to the ground plane.

14. The antenna assembly of claim 1, wherein the driven element and the parasitic element are formed as a unitary structure.

15. The antenna assembly of claim 7, further comprising a coupling element joining the first leg element of the driven element, the first leg element of the parasitic element and the leg member of the second parasitic element together, the coupling element having a foot for operatively connecting the driven and parasitic elements to the ground plane.

16. The antenna assembly of claim 15, wherein the driven element, the coupling element and the parasitic elements are formed as a unitary structure.

17. The antenna assembly of claim 1, wherein the driven element defines an interior region.

18. The antenna assembly of claim 17, wherein the driven element is generally c-shaped.

19. The antenna assembly of claim 1, wherein the parasitic element defines an interior region.

20. The antenna assembly of claim 19, wherein the parasitic element is generally c-shaped.

21. The antenna assembly of claim 20, wherein the first conductive surface of the driven element and the first conductive surface of the parasitic element are substantially coextensive.

22. The antenna assembly of claim 21, wherein the first conductive surfaces of the driven and parasitic elements are substantially planar.

23. The antenna assembly of claim 1, further comprising a dielectric material interposed between the first conductive surface of the driven element, the first conductive surface of the parasitic element, and the ground plane.

24. The antenna assembly of claim 23, further comprising a tuner element operatively connected to the driven element.

25. The antenna assembly of claim 23, wherein the driven element and the parasitic element are substantially disposed upon the dielectric material.

26. A method of manufacturing an antenna assembly for use in a telecommunication device having a ground plane and a RF signal conductor, the method including the steps of:

forming a driven element out of a substantially planar conductive material, said driven element including a first conductive surface and a first leg element and a second leg element, each of said first and second leg elements being at an angle relative to the first conductive surface;

coupling the driven element relative to the ground plane of a printed wiring board so that the first conductive surface is disposed a predetermined distance away from the ground plane and the first leg element is conductively coupled to the ground plane and the second leg element is capacitively coupled to the ground plane;

forming a parasitic element out of the conductive material, said parasitic element including a first conductive surface and a first leg element and a second leg element, each of said first and second leg elements being at an angle relative to the first conductive surface;

coupling the parasitic element relative to the ground plane of the printed wiring board so that the first conductive surface is disposed a predetermined distance away from the ground plane and the first leg element is conductively coupled to the ground plane and the second leg element is capacitively coupled to the ground plane; and coupling the signal conductor of the telecommunication device at a feed point defined upon the first conductive surface of the driven element.

27. The method of claim 26, wherein the step of forming the driven element comprises the steps of:

stamping the driven element from a sheet of conductive material, and bending ends of the stamped piece to form the first and second leg elements.

28. The method of claim 26, wherein the step of forming the parasitic element comprises the steps of:

stamping the driven element from a sheet of conductive material, and bending ends of the stamped piece to form the first and second leg elements.

29. The method of claim 27, wherein the step of bending the ends of the stamped piece further includes the step of forming a foot at the end of the first and second leg elements.

30. The method of claim 28, wherein the step of bending the ends of the stamped piece further includes the step of forming a foot at the end of the first and second leg elements.

* * * * *